US011009277B2

(12) United States Patent
Mitchell

(10) Patent No.: US 11,009,277 B2
(45) Date of Patent: May 18, 2021

(54) REFRIGATOR APPLICANCES HAVING A REMOVABLE ICE STORAGE BIN

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 13 days.

(21) Appl. No.: 16/412,846

(22) Filed: May 15, 2019

(65) Prior Publication Data

US 2020/0363115 A1 Nov. 19, 2020

(51) Int. Cl.

| | |
|---|---|
| ***F25C 5/182*** | (2018.01) |
| ***F25D 23/04*** | (2006.01) |
| ***F25C 5/20*** | (2018.01) |

(52) U.S. Cl.

CPC ..... *F25C 5/182* (2013.01); *F25C 5/22* (2018.01); *F25C 5/24* (2018.01); *F25D 23/04* (2013.01); *F25C 2400/10* (2013.01)

(58) Field of Classification Search

CPC .... F25C 5/182; F25C 5/22; F25C 5/24; F25D 23/04; F25D 2323/023

See application file for complete search history.

(56) References Cited

U.S. PATENT DOCUMENTS

| | | | | |
|---|---|---|---|---|
| 3,744,270 | A * | 7/1973 | Wilcox | F25D 25/025 62/344 |
| 4,087,140 | A * | 5/1978 | Linstromberg | F25D 23/02 312/292 |
| 8,312,735 | B2 | 11/2012 | Fulton | |
| 8,353,179 | B2 | 1/2013 | Kim et al. | |
| 8,745,992 | B2 | 6/2014 | Cheong et al. | |
| 2016/0047591 | A1* | 2/2016 | Jeong | F25D 21/00 62/344 |
| 2018/0363966 | A1 | 12/2018 | Hottenroth et al. | |
| 2020/0248947 | A1* | 8/2020 | Jeong | F25C 5/046 |

* cited by examiner

*Primary Examiner* — Cassey D Bauer
(74) *Attorney, Agent, or Firm* — Dority & Manning, P.A.

(57) ABSTRACT

A refrigerator appliance, as provided herein, may include a cabinet, a door, a dispensing assembly, an icemaker, and an ice storage bin. The door may define a bin opening and a dispenser recess. The dispensing assembly may be positioned within the dispenser recess and define an ice delivery passage. The ice storage bin may define a storage cavity. The ice storage bin may be slidably mounted to the door to move through the bin opening between a mounted position and a removed position. The ice storage bin may include an insulated front wall positioned across the bin opening in the mounted position. The storage cavity may be in communication with the icemaker in the mounted position to receive ice therefrom. The storage cavity may further be in communication with the dispensing assembly in the mounted position to direct ice to the ice delivery passage.

18 Claims, 6 Drawing Sheets

REFRIGATOR APPLICANCES HAVING A REMOVABLE ICE STORAGE BIN

FIELD OF THE INVENTION

The present subject matter relates generally to refrigerator appliances, and more particularly to refrigerator appliances having an ice storage bin that can be readily removed from and returned to a corresponding refrigerator appliance.

BACKGROUND OF THE INVENTION

Refrigerator appliances generally include a cabinet that defines one or more chilled chambers for receipt of food articles for storage. In addition, refrigerator appliances also generally include a door rotatably hinged to the cabinet to permit selective access to food items stored in chilled chamber(s). Certain refrigerator appliances include an icemaker. In order to produce ice, liquid water is directed to the icemaker and frozen. After being frozen, ice may be directed to a separate ice storage bin. In order to maintain ice in a frozen state, the ice storage bin may be positioned within one of the chilled chambers or a separate compartment behind one of the doors.

Although the ice storage bin of a refrigerator appliance may be accessible to a user, such access generally requires opening a door to the chilled chamber. Thus, if a user wishes to draw ice directly from the ice storage bin, relatively hot ambient air will be introduced to the chilled chamber. The introduction of ambient air may greatly increase the temperature within the chilled chamber and reduce the overall efficiency of the refrigerator appliance. Some systems may provide a dispenser assembly in the door to direct ice from the icemaker or ice storage bin to an area outside of the refrigerator appliance. However, such a dispenser assembly generally only provides a limited area from which ice may be dispensed.

Similar, if not greater concerns, may arise if a user simply wishes to view the contents of the ice storage bin (e.g., to see how much ice is currently stored within the ice storage bin). A user is generally required to open the door of the refrigerator appliance to view of the ice storage bin.

Accordingly, it would be advantageous to provide a refrigerator appliance with feature(s) addressing one or more of the above-identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a door, a dispensing assembly, an icemaker, and an ice storage bin. The cabinet may define a chilled chamber. The door may define a bin opening and a dispenser recess. The door may be rotatably hinged to the cabinet to rotate between a closed position restricting access to the chilled chamber and an open position permitting access to the chilled chamber. The dispensing assembly may be positioned within the dispenser recess and define an ice delivery passage. The icemaker may be in selective communication with the dispensing assembly. The ice storage bin may define a storage cavity. The ice storage bin may be slidably mounted to the door to move through the bin opening between a mounted position and a removed position. The ice storage bin may include an insulated front wall positioned across the bin opening in the mounted position. The storage cavity may be in communication with the icemaker in the mounted position to receive ice therefrom. The storage cavity may further be in communication with the dispensing assembly in the mounted position to direct ice to the ice delivery passage.

In another exemplary aspect of the present disclosure, a refrigerator appliance is provided. The refrigerator appliance may include a cabinet, a door, a dispensing assembly, an icemaker, an ice storage bin, and a motor. The cabinet may define a chilled chamber. The door may define a bin opening and a dispenser recess. The door may be rotatably hinged to the cabinet to rotate between a closed position restricting access to the chilled chamber and an open position permitting access to the chilled chamber. The dispensing assembly may be positioned within the dispenser recess and define an ice delivery passage. The icemaker may be in selective communication with the dispensing assembly. The ice storage bin may define a storage cavity. The ice storage bin may be slidably mounted to the door to move through the bin opening between a mounted position and a removed position. The storage cavity may be in communication with the icemaker in the mounted position to receive ice therefrom. The storage cavity may be in communication with the dispensing assembly in the mounted position to direct ice to the ice delivery passage. The motor may be mounted to the door and operably coupled to the ice storage bin in the mounted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
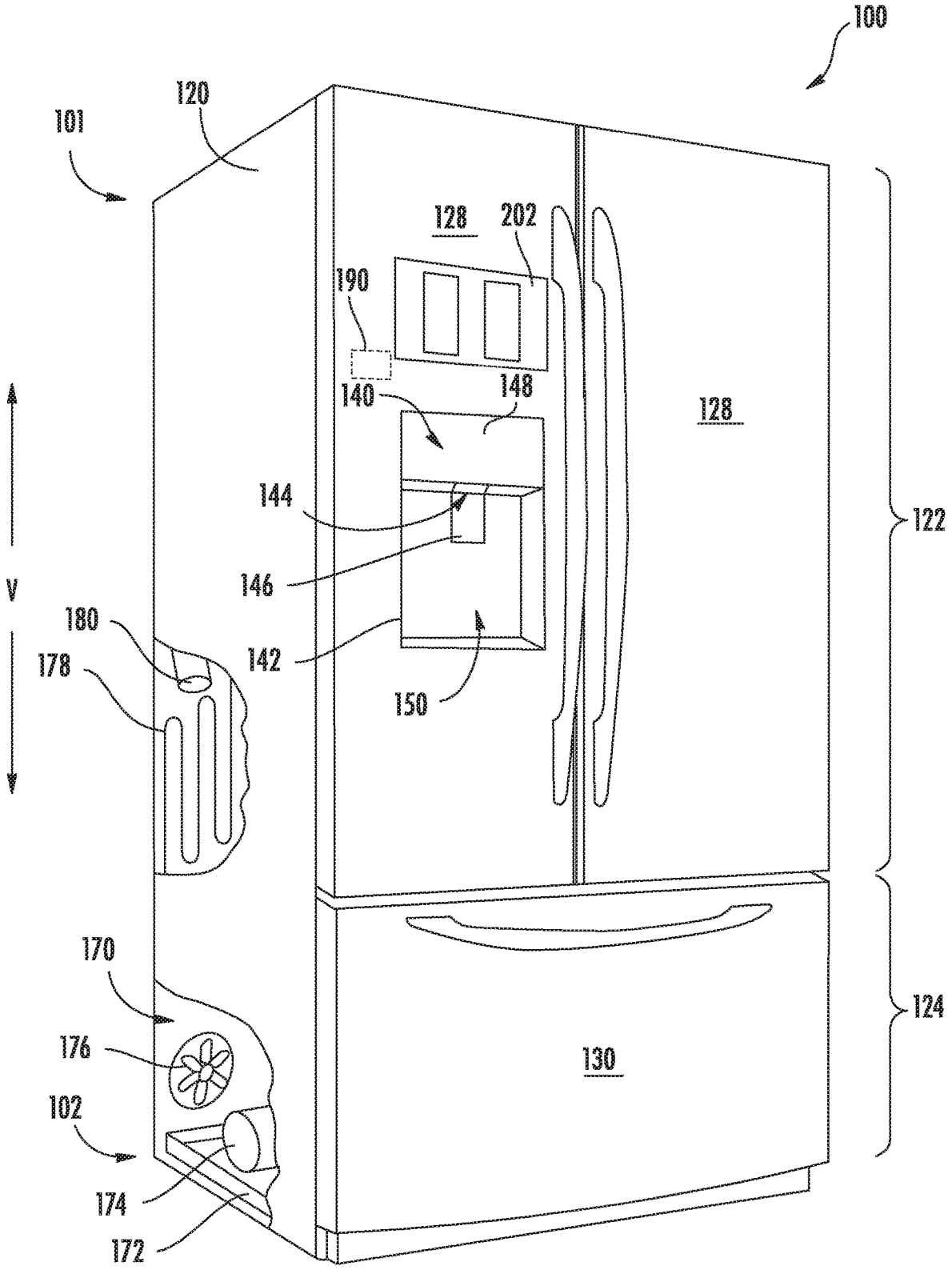
FIG. 1 provides a perspective view of a refrigerator appliance according to exemplary embodiments of the present disclosure, wherein refrigerator doors are shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
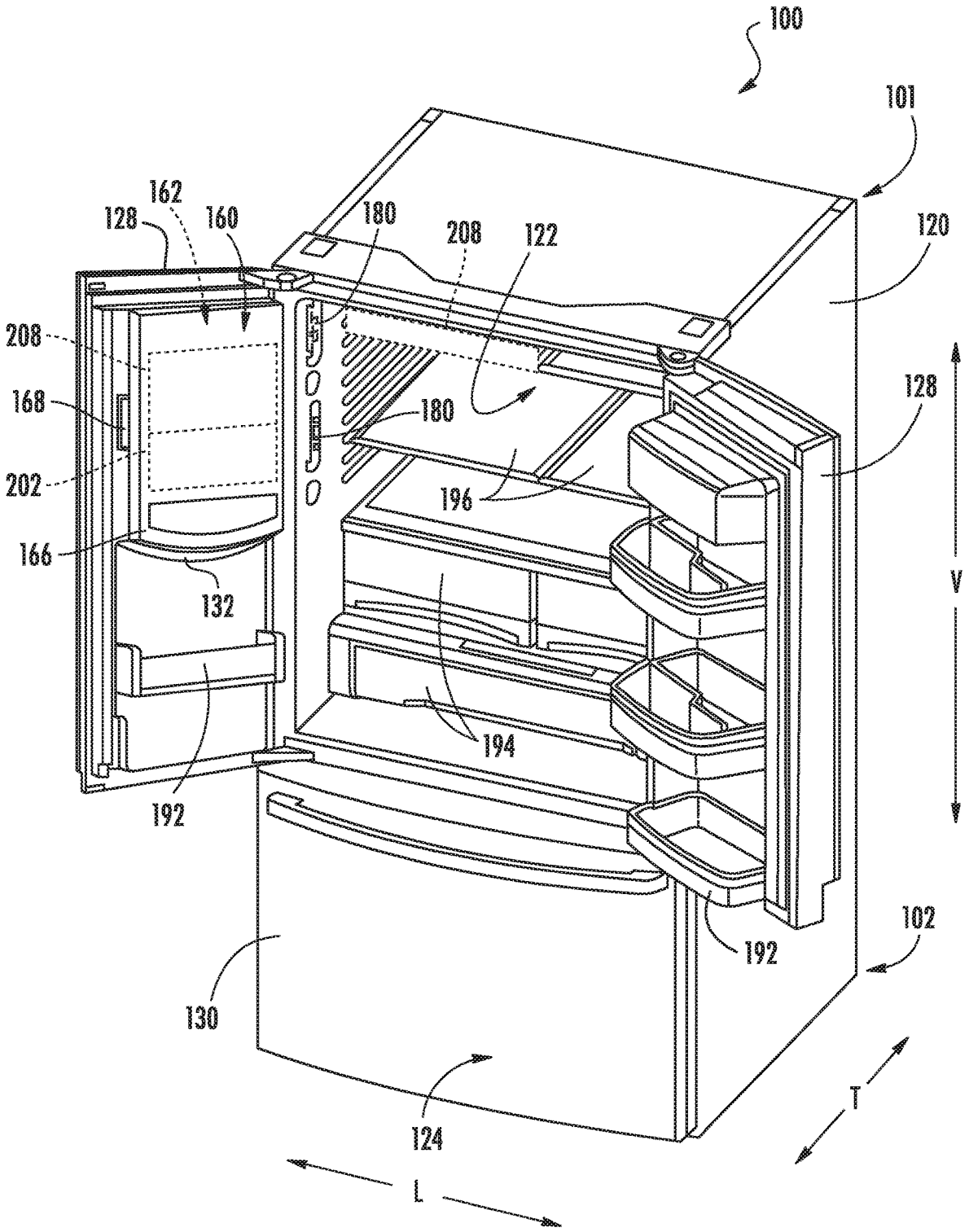
FIG. 2 provides a perspective view of the example refrigerator appliance of FIG. 1, wherein refrigerator doors are shown in an open position to reveal a fresh food chamber.

Referring now to the drawings, FIGS. 1 and 2 provide perspective views of a refrigerator appliance 100 according to example embodiments of the present disclosure. Generally, FIG. 1 provides a pair of refrigerator doors 128 in a closed position, while FIG. 2 provides refrigerator doors 128 in an open position.

Refrigerator appliance 100 includes a cabinet or housing 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. Cabinet 120 defines one or more chilled chambers for receipt of food items for storage. In some embodiments, cabinet 120 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

In exemplary embodiments, various storage components are mounted within fresh food chamber 122 to facilitate storage of food items therein, as will be understood by those skilled in the art. In particular, the storage components may include storage bins 192, drawers 194, and shelves 196 that are mounted within fresh food chamber 122. Storage bins 192, drawers 194, and shelves 196 are configured for receipt of food items (e.g., beverages or solid food items) and may assist with organizing such food items. As an example, drawers 194 can receive fresh food items (e.g., vegetables, fruits, or cheeses) and increase the useful life of such fresh food items.

Refrigerator doors 128 are rotatably hinged to an edge of cabinet 120 for selectively accessing fresh food chamber 122. In some embodiments, a freezer door 130 is arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in the closed configuration in FIG. 1.

In some embodiments, refrigerator appliance 100 includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, another suitable actuator may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, as will be described in greater detail below. Generally, dispenser recess 150 defines a transverse opening 151 that extends in the vertical direction V from a top recess end 152 to a bottom recess end 154, as well as in the lateral direction L from a first recess side 156 to a second recess side 158. In certain embodiments, dispenser recess 150 is positioned at a predetermined elevation convenient for a user to access ice or water and enabling the user to access ice without the need to bend-over and without the need to open doors 128. In optional embodiments, dispenser recess 150 is positioned at a level that approximates the chest level of a user.

As will be discussed below, refrigerator appliance 100 may include an ice-making assembly 160 in communication (e.g., physical communication, fluid communication, etc.) with dispensing assembly 140. For instance, an ice storage bin 202 may be mounted above discharging outlet 144 to direct ice thereto.

In certain embodiments, at least one door 128 defines a bin opening 204 through an external panel thereof to receive the ice storage bin 202 in the closed position. A bin compartment 206 extending from the bin opening 204 may be defined within the corresponding door 128 to further receive and house the ice storage bin 202 in the closed position.

In some embodiments, ice-making assembly 160 includes an icemaker 208 that is generally received within at least one chilled chamber (e.g., fresh food chamber 122), such as when when the corresponding door 128 is in the closed position. As an example, icemaker 208 may be attached (e.g., directly attached) to one of doors 128. As another example, icemaker 208 may be directly attached to cabinet 120 and fixed within a chilled chamber (e.g., rearward of door 128, as illustrated in phantom lines in FIG. 2).

In some embodiments, at least one door 128 includes a door liner 132 defining a sub-compartment (e.g., icebox compartment 162). Icebox compartment 162 extends into fresh food chamber 122 when door 128 is in the closed position. Moreover, although icebox compartment 162 is shown in door 128, alterative embodiments may include an icebox compartment 162 fixed within fresh food chamber 122.

During use, ice may be supplied to dispenser recess 150 from a portion of ice-making assembly 160 in icebox compartment 162 on a back side of refrigerator door 128.

In exemplary embodiments, chilled air from a sealed system of refrigerator appliance 100 may be directed into ice-making assembly 160 in order to cool components of ice-making assembly 160. In particular, an evaporator 178 (e.g., positioned at or within fresh food chamber 122 or freezer chamber 124) is configured for generating cooled or chilled air. A supply conduit 180 (e.g., defined by or positioned within housing 120) extends between evaporator 178 and components of ice-making assembly 160 in order to cool components of ice-making assembly 160 and assist ice formation by ice-making assembly 160.

In some embodiments, during operation of ice-making assembly 160, chilled air from the sealed system cools components of ice-making assembly 160 to or below a freezing temperature of liquid water. Thus, ice-making assembly 160 may be an air cooled ice-making assembly.

In optional embodiments, liquid water generated during melting of ice cubes in ice storage bin 202, is directed out of ice storage bin 202. For example, turning back to FIG. 1, liquid water from melted ice cubes may be directed to an evaporation pan 172. Evaporation pan 172 is positioned within a mechanical compartment 170 defined by housing 120 (e.g., at bottom portion 102 of housing 120). A condenser 174 of the sealed system can be positioned, for example, directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 may be sized and shaped for facilitating evaporation of liquid water therein. For example, evaporation pan 172 may be open topped and extend across about a width or a depth of housing 120.

In some embodiments, an access door 166 is hinged to refrigerator door 128. Access door 166 may permit selective access to sub-compartment 162. Any manner of suitable latch 168 may further be configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Generally, operation of the refrigerator appliance 100 can be regulated by a controller 190 that is operatively coupled to user interface panel 148 or various other components. User interface panel 148 provides selections for user manipulation of the operation of refrigerator appliance 100, such as selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located adjacent to or on user interface panel 148. In other embodiments, controller 190 may be positioned at another suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in operable communication (e.g., electrical communication) with controller 190 via one or more signal lines or shared communication busses.

Controller 190 may be operatively coupled with the various components of dispensing assembly 140 and may control operation of the various components. For example, the various valves, switches, etc. may be actuatable based on commands from controller 190. As discussed, interface panel 148 may additionally be operatively coupled (e.g., via electrical or wireless communication) with controller 190. Thus, the various operations may occur based on user input or automatically through controller 190 instruction.

Figure 3:
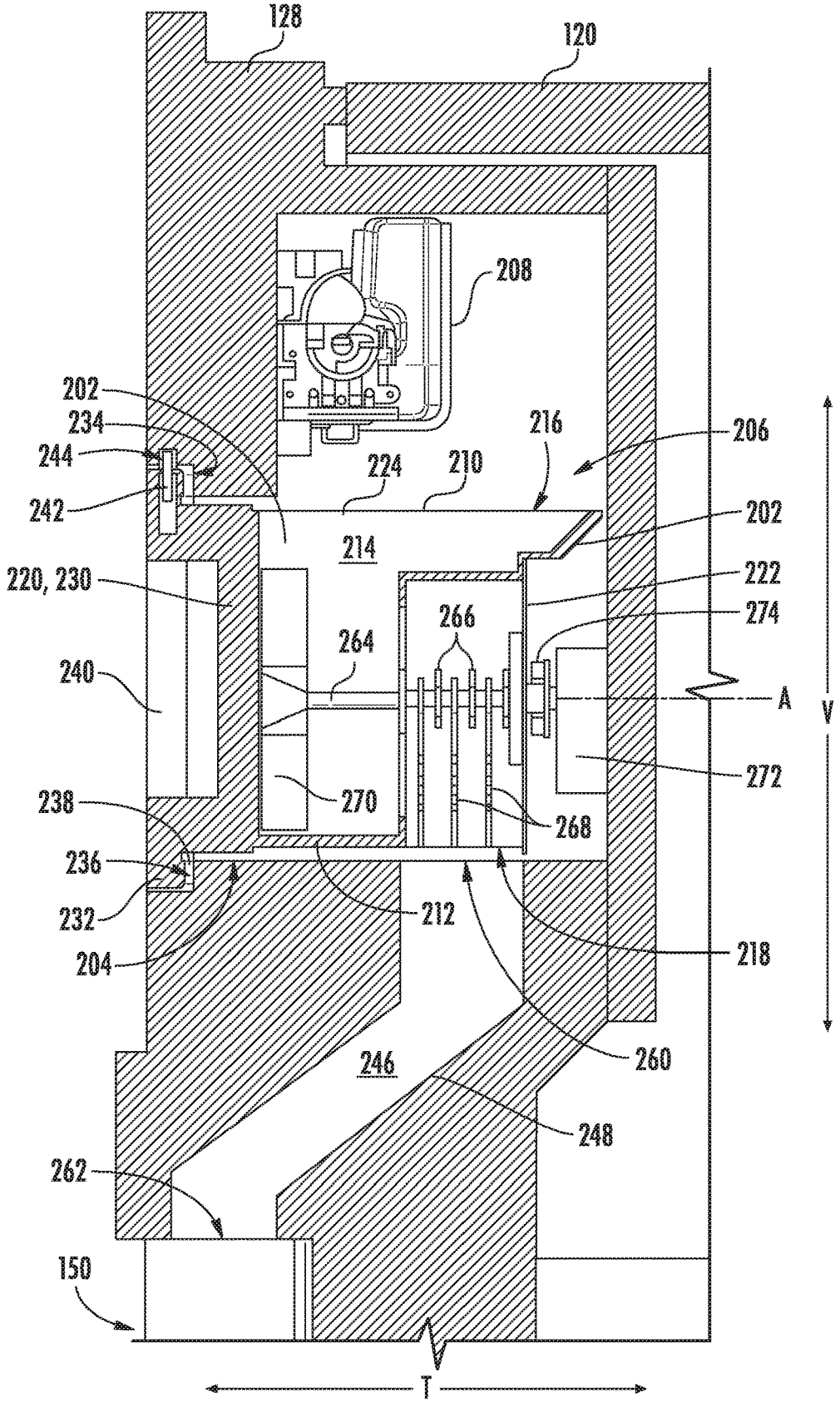
FIG. 3 provides a sectional schematic view of an ice bin within a door of a refrigerator appliance according to exemplary embodiments of the present disclosure.
Figure 4:
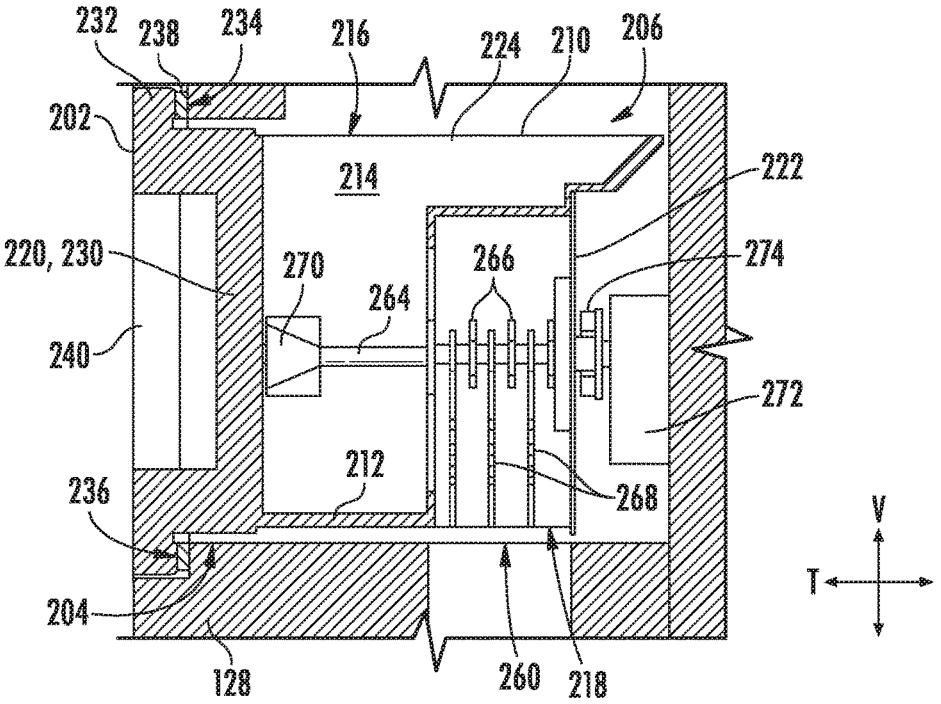
FIG. 4 provides a sectional schematic view of an ice bin in a mounted position according to exemplary embodiments of the present disclosure.
Figure 5:
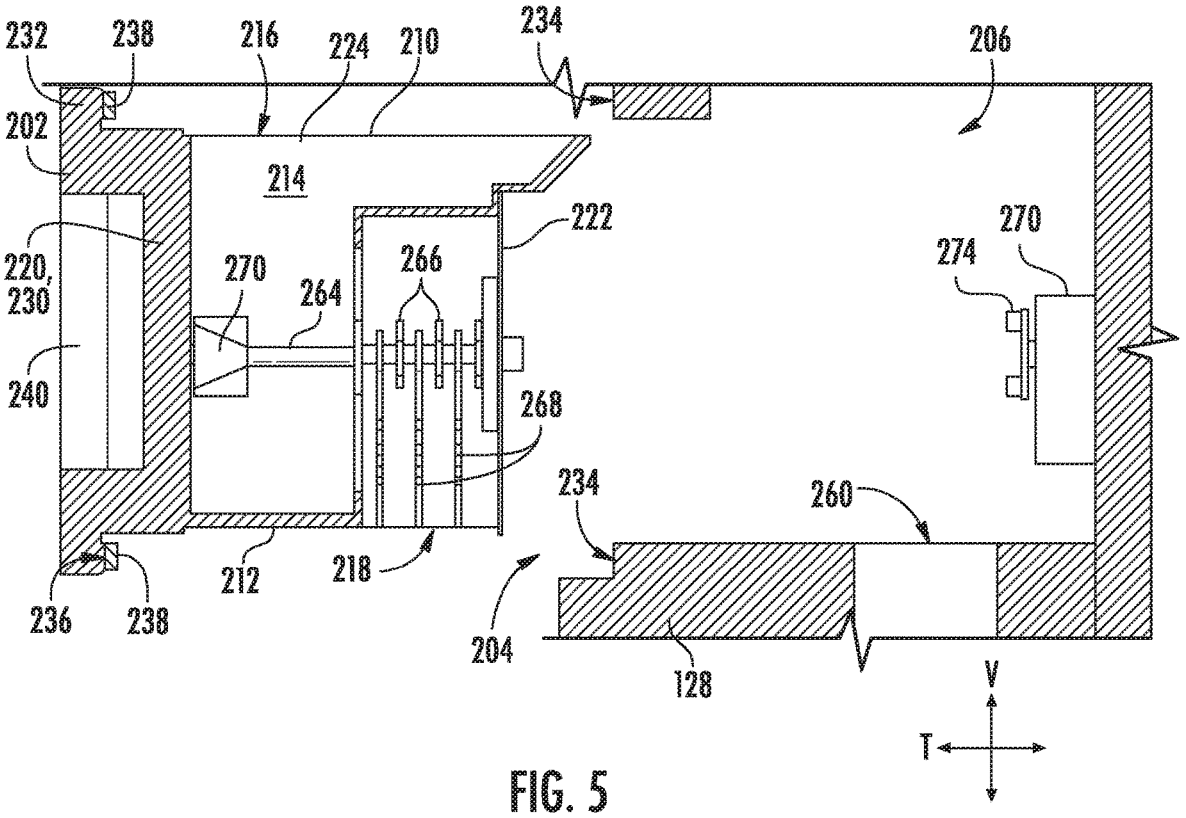
FIG. 5 provides a sectional schematic view of an ice bin in a removed position according to exemplary embodiments of the present disclosure.
Figure 6:
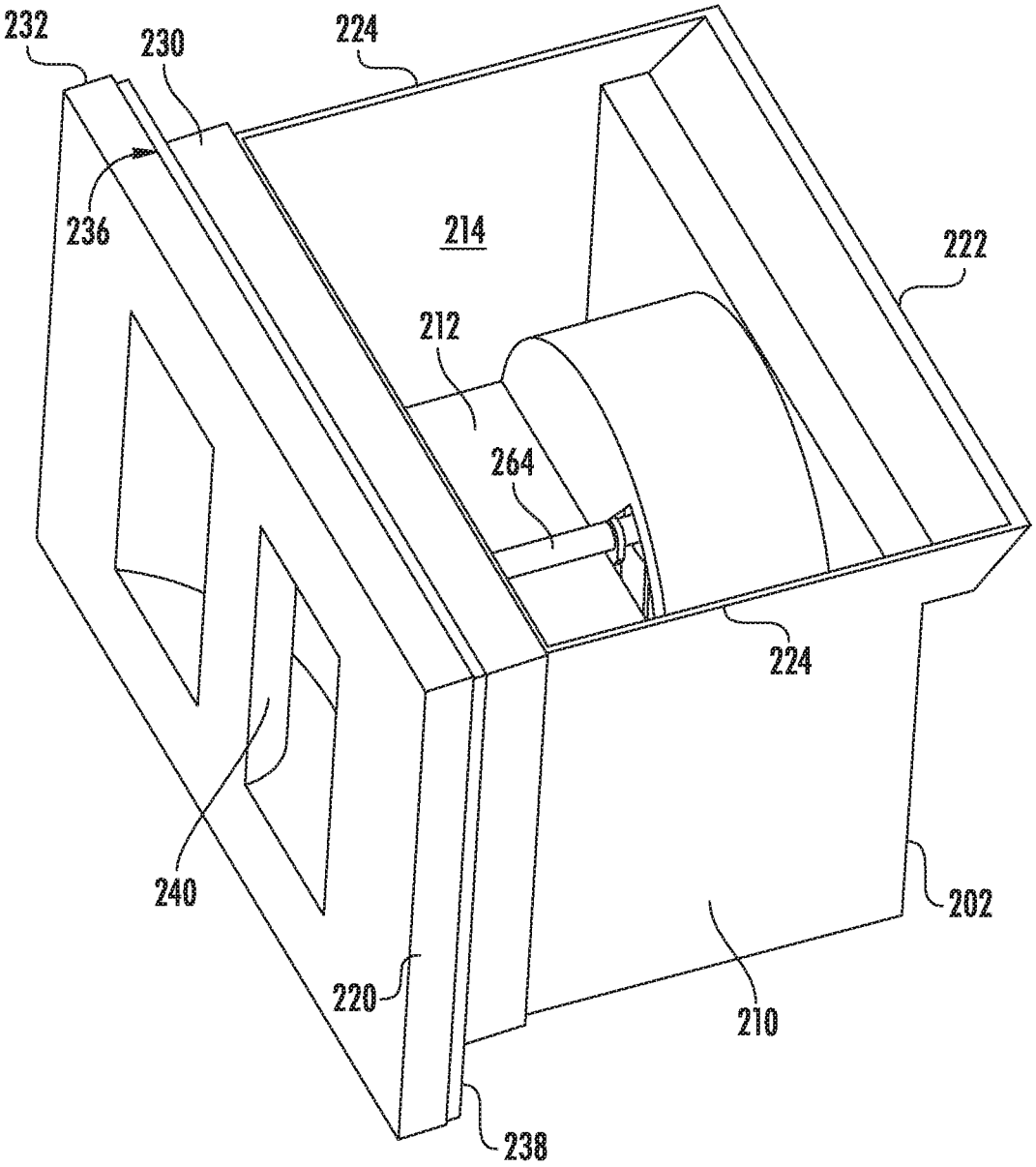
FIG. 6 provides a perspective view of an ice bin according to exemplary embodiments of the present disclosure.
Figure 7:
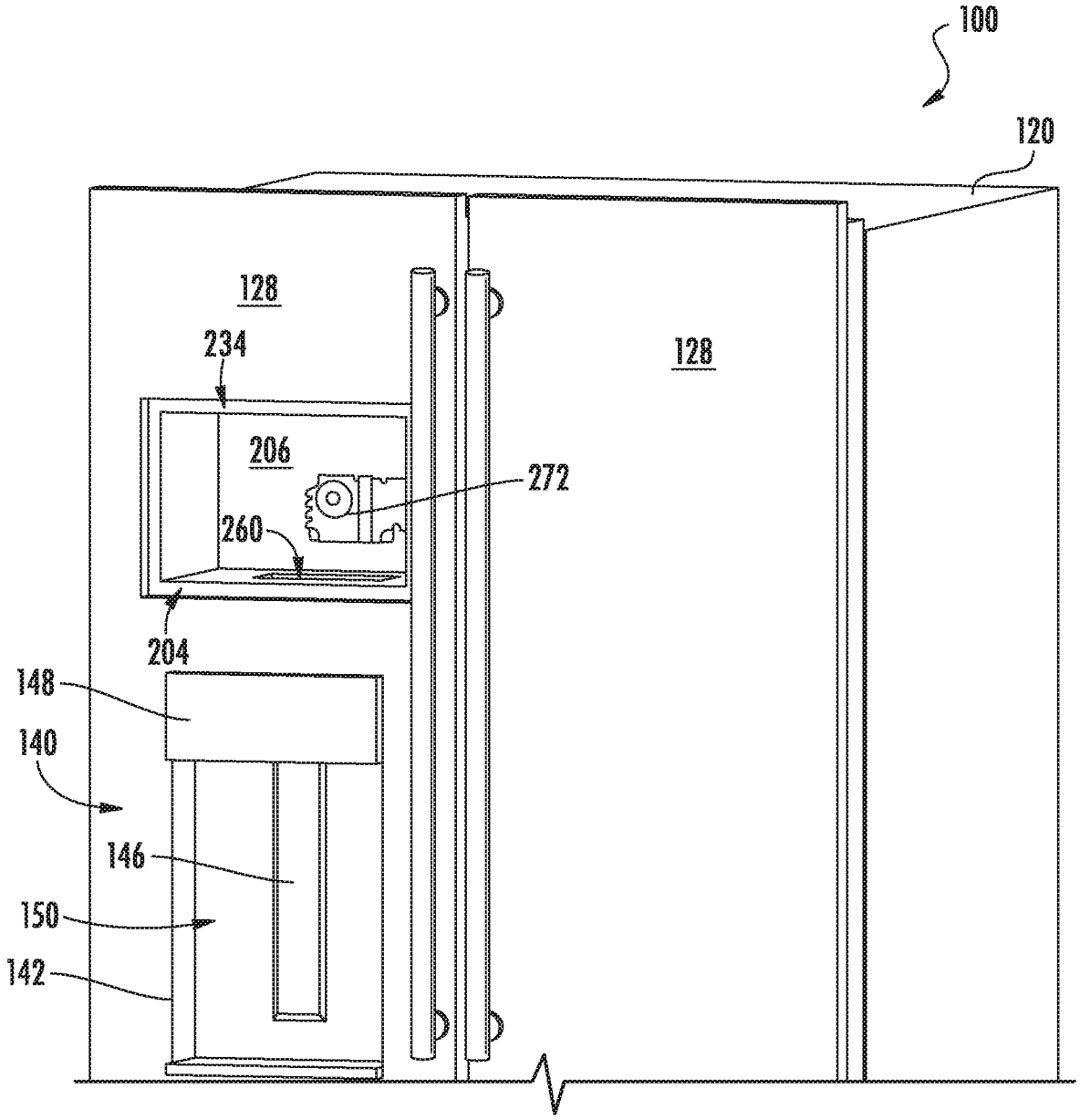
FIG. 7 provides perspective view of a portion of a refrigerator appliance wherein an ice bin has been removed according to exemplary embodiments of the present disclosure.

Turning now generally to FIGS. 3 through 7, various views are provided of ice storage bin 202 and a corresponding door 128 within which ice storage bin 202 may be received. Specifically, FIGS. 3 through 5 provide schematic views of ice storage bin 202 in relation to door 128. FIG. 6 provides a perspective view of ice storage bin 202 in isolation. FIG. 7 provides a perspective view that includes a portion of door 128 when ice storage bin 202 has been removed from bin compartment 206.

As shown, ice storage bin 202 generally includes a plurality of walls defining a storage cavity 214. For instance, ice storage bin 202 may include one or more sidewalls 210 and a base wall 212, which may together define storage cavity 214. In some such embodiments, the sidewalls 210 include a front wall 220, rear wall 222, and a pair of intermediate walls 224 therebetween. Together, the sidewalls 210 define an opening perimeter 216 at a top portion (e.g., vertical extreme opposite the base wall 212) of container ice storage bin 202. As shown, opening perimeter 216 (e.g., defined by front wall 220, rear wall 222, and intermediate walls 224) may permit access to storage cavity 214 (e.g., to add or remove ice therein). In turn, the storage cavity 214 may be in communication (e.g., selective physical communication, fluid communication, etc.) with icemaker 208 to receive ice therefrom. In specific embodiments, icemaker 208 is mounted above bin opening 204 or bin compartment 206 along the vertical direction V. Thus, icemaker 208 may be positioned above storage bin 202 (e.g., over the opening perimeter 216).

In exemplary embodiments, ice storage bin 202 is slidably mounted to door 128 to move through bin opening 204 between a mounted position (e.g., FIG. 4) and a removed position (e.g., FIG. 5). Generally, the mounted position may restrict user access to storage cavity 214 (e.g., through the opening perimeter 216) while the removed position may permit access to storage cavity 214 (e.g., through the opening perimeter 216). Specifically, in the mounted position, at least a portion of ice storage bin 202 is received within bin compartment 206. Moreover, storage cavity 214 may be in communication (e.g., fluid communication) within icemaker 208, such that ice cubes can be received therefrom. By contrast, in the removed position, storage cavity 214 may be offset or out of alignment with bin compartment 206. For instance, ice storage bin 202 and storage cavity 214 may be completely removed from bin compartment 206 or door 128. In the removed position, ice storage bin 202 may move independently from door 128 and the rest of refrigerator appliance 100. The removed position may thus permit a user to place ice storage bin 202 on a counter or dump ice directly therefrom (e.g., through opening perimeter 216). Advantageously, ice storage bin 202 may be accessed without exposing fresh food chamber 122 (FIG. 2) to ambient air.

In certain embodiments, storage bin 202 is slidable along a direction perpendicular to the vertical direction V, such as along the transverse direction T (e.g., as defined when the corresponding door 128 is in the closed position). In moving between the mounted position and the removed position, ice storage bin 202 may slide linearly along the transverse direction T.

In some embodiments, ice storage bin 202 includes at least one insulated sidewall 230. For instance, insulated sidewall 230 may be provided as or include front wall 220 (e.g., adjacent to an external panel of door 128 in a mounted position). Optionally, insulated sidewall 230 may define a wall thickness (e.g., in the transverse direction T or radially outward from storage cavity 214) that is greater than the wall thickness of the other sidewalls 210 or base wall 212. Additionally or alternatively, a separate insulator (e.g., a suitable rigid or foam insulation) may be enclosed within a solid shell to form insulated sidewall 230.

When ice storage bin 202 is inserted into bin opening 204 and bin compartment 206 (e.g., in the mounted position), the insulated sidewall 230 may be positioned across bin opening 204. In some such embodiments, a radial edge 232 of insulated sidewall 230 extends outward from bin opening 204. In other words, insulated sidewall 230 may define a footprint (e.g., lateral width or vertical height) greater than an outer perimeter or periphery 234 of bin opening 204. An inner surface 236 of insulated sidewall 230 may contact (e.g., directly or indirectly) a portion of door 128 surrounding bin opening 204. Optionally, a sealing gasket 238 may be attached to the inner surface 236 of insulated sidewall 230. In a mounted position, sealing gasket 238 may be positioned about the periphery 234 of bin opening 204 (e.g., to restrict heat transfer between bin compartment 206 and the ambient environment).

In certain embodiments, front wall 220 includes an unobstructed handle 240. In the mounted position, unobstructed handle 240 may be readily grasped (e.g., by a user) and free from a cover restricting access to unobstructed handle 240. As shown, front wall 220 may provide unobstructed handle 240 directly in front of storage cavity 214 (e.g., along the transverse direction T). Additionally or alternatively, unobstructed handle 240 may extend perpendicular to the direction of movement for ice storage bin 202. For instance, unobstructed handle 240 may extend along the vertical direction V (e.g., such that the vertical dimension is greater than a dimension in a lateral direction L or transverse direction T, as shown).

In optional embodiments, a mechanical latch 242 is provided on front wall 220 to selectively engage a corresponding catch or recess 244 defined within door 128. For instance, in the mounted position, mechanical latch 242 may be received within recess 244 to secure ice storage bin 202 in the mounted position. As is understood, a trigger (e.g., movably mounted on unobstructed handle 240) may be provided to selectively release mechanical latch 242.

As shown, especially in FIG. 5, storage cavity 214 is in communication (e.g., fluid communication) with the dispensing assembly 140 in the mounted position, such as to direct ice to the ice delivery passage 246 (e.g., via a base aperture 218 defined through ice storage bin 202 from storage cavity 214). In some such embodiments, ice storage bin 202 is mountable above dispenser recess 150. Optionally, bin opening 204 is defined above dispenser recess 150.

As shown, dispensing assembly 140 generally defines an ice delivery passage 246 in communication with storage bin 202 (e.g., in the mounted position). For instance, dispensing assembly 140 may include a dispenser conduit 248 defining an ice delivery passage 246 through door 128.

Generally, ice delivery passage 246 extends between an inlet 260 and an outlet 262. Inlet 260 of ice delivery passage 246 is positioned at or adjacent ice storage bin 202 (e.g., beneath base aperture 218), and outlet 262 of ice delivery passage 246 is positioned at or adjacent a top portion of dispenser recess 150 (e.g., such that outlet 262 forms or corresponds to discharging outlet 144—FIG. 1). Inlet 260 of ice delivery passage 246 may be positioned above outlet 262 of ice delivery passage 246 along the vertical direction V (e.g., such that gravity urges ice nuggets or cubes through ice delivery passage 246 to outlet 262). For instance, ice may be generally urged through base aperture 218. From base aperture 218, ice may thus flow to ice delivery passage 246 after passing through inlet 260.

Ice storage bin 202 may include one or more features for directing or motivating ice within storage cavity 214. In exemplary embodiments, a driven rod 264 is provided on or within ice storage bin 202. For instance, driven rod 264 may extend along a rotation axis A within storage cavity 214.

In certain embodiments, a plurality of ice crusher blades 266, 268 are positioned within ice storage bin 202. For instance, multiple ice crusher blades 266, 268 may be positioned on or around driven rod 264. In optional embodiments, the plurality of blades 266, 268 includes at least one rotary blade 266 and at least one stationary blade 268. Rotary blades may be fixed to driven rod 264 (e.g., to rotate therewith) while stationary blades 268 may be fixed to another portion of bin 202 (e.g., one or more sidewalls 210 or base wall 212) such that rotation of driven rod 264 does not rotate stationary blades 268. If multiple rotary blades 266 are provided, the rotary blades 266 may be distributed on a rotation axis A or driven rod 264 such that the rotary blades 266 are staggered along the driven rod 264. The stationary blade(s) 268 may be staggered or positioned between rotary blades 266. During use, a single rotary blade 266 may thus crush ice against the stationary blade(s) 268 as ice passes to the base aperture 218.

In additional or alternative embodiments, a rotatable agitator paddle 270 may be fixed to driven rod 264 to guide or move ice through storage cavity 214. For instance, agitator paddle 270 may be positioned opposite from ice blades 266, 268 on driven rod 264 (e.g., at opposite ends of rotation axis A). In some such embodiments, blades 266, 268 and rotatable agitator paddle 270 may rotate about driven rod 264, in unison, such that rotary blades 266 and agitator paddle 270 rotate at about the same angular velocity.

In further additional or alternative embodiments, a motor 272 is provided on or within door 128 to selectively engage a portion of ice storage bin 202. For instance, motor 272 may be mounted to door 128, such as at a rear portion of bin compartment 206. Optionally, motor 272 may be fixed to a portion of liner wall 132 or access door 166 (FIG. 2) on or within bin compartment 206. In the mounted position, motor 272 may be operably coupled (e.g., in mechanical communication with) a portion of ice storage bin 202. As an example, motor 272 may be coupled to driven rod 264.

In certain embodiments, motor 272 includes an adapter key 274 to selectively engage driven rod 264. For instance, when ice storage bin 202 is in the mounted position, adapter key 274 may mechanically couple with driven rod 264 in a horizontal connection beside rear wall 222. During use, bin motor 272 may motivate rotation of adapter key 274 and driven rod 264 about the rotation axis A, which in turn motivates rotation of blades 266, 268 or agitator paddle 270. The horizontal connection between motor 272 and driven rod 264 may permit ice storage bin 202 to slide horizontally (i.e., perpendicular to the vertical direction V) into attachment with refrigerator appliance 100 (FIG. 2) without requiring any vertical movement or motion from ice storage bin 202. Advantageously, a user may attach or remove storage ice storage bin 202 from refrigerator appliance 100 without lifting ice storage bin 202 up and over bin motor 272.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber;

a door defining a bin opening and a dispenser recess, the door being rotatably hinged to the cabinet to rotate between a closed position restricting access to the chilled chamber and an open position permitting access to the chilled chamber;

a dispensing assembly positioned within the dispenser recess and defining an ice delivery passage;

an icemaker in selective communication with the dispensing assembly;

an ice storage bin defining a storage cavity, the ice storage bin being slidably mounted to the door to move horizontally along a rotation axis through the bin opening between a mounted position and a removed position, the ice storage bin comprising an insulated front wall positioned across the bin opening in the mounted position, the storage cavity being in communication with the icemaker in the mounted position to receive ice therefrom, the storage cavity being in communication with the dispensing assembly in the mounted position to direct ice to the ice delivery passage; and a motor mounted to the door;

wherein the ice storage bin comprises a driven rod extending horizontally along the rotation axis within the storage cavity, the driven rod being selectively coupled to the motor in the mounted position and rotatable about the rotation axis parallel with a horizontal direction.

2. The refrigerator appliance of claim 1, wherein the icemaker is mounted above the ice storage bin along a vertical direction.

3. The refrigerator appliance of claim 1, wherein the bin opening is defined above the dispenser recess along a vertical direction.

4. The refrigerator appliance of claim 1, wherein the insulated front wall includes an unobstructed handle positioned in front of the storage cavity.

5. The refrigerator appliance of claim 1, wherein the ice storage bin further comprises a sealing gasket attached to an inner surface of the insulated front wall, wherein the sealing gasket is positioned about a periphery of the bin opening in the mounted position.

6. The refrigerator appliance of claim 1, wherein the ice storage bin further comprises a plurality of ice crusher blades fixed to the driven rod to rotate therewith about the rotation axis.

7. The refrigerator appliance of claim 1, wherein the ice storage bin further comprises an agitator paddle fixed to the driven rod to rotate therewith about the rotation axis.

8. The refrigerator appliance of claim 1, wherein the icemaker is mounted directly to the door.

9. The refrigerator appliance of claim 1, wherein the icemaker is mounted directly to the cabinet.

10. A refrigerator appliance comprising:

a cabinet defining a chilled chamber;

a door defining a bin opening and a dispenser recess below the bin opening, the door being rotatably hinged to the cabinet to rotate between a closed position restricting access to the chilled chamber and an open position permitting access to the chilled chamber;

a dispensing assembly positioned within the dispenser recess and defining an ice delivery passage;

an icemaker in selective communication with the dispensing assembly;

an ice storage bin defining a storage cavity, the ice storage bin being slidably mounted to the door to move horizontally along a rotation axis through the bin opening between a mounted position and a removed position, the ice storage bin comprising an insulated front wall positioned across the bin opening in the mounted position, the storage cavity being in communication with the icemaker in the mounted position to receive ice therefrom, the storage cavity being in communication with the dispensing assembly in the mounted position to direct ice to the ice delivery passage; and a motor mounted to the door and operably coupled to the ice storage bin in the mounted position; and an adapter key fixed to the motor to rotate about the rotation axis parallel to a horizontal direction, the motor being operably coupled to the ice storage bin through the adapter key, wherein the ice storage bin comprises a driven rod extending horizontally along the rotation axis within the storage cavity, the driven rod being selectively coupled to the adapter key.

11. The refrigerator appliance of claim 10, wherein the icemaker is mounted above the ice storage bin along a vertical direction.

12. The refrigerator appliance of claim 10, wherein the insulated front wall includes an unobstructed handle positioned in front of the storage cavity.

13. The refrigerator appliance of claim 10, wherein the ice storage bin further comprises a sealing gasket attached to an inner surface of the insulated front wall, wherein the sealing gasket is positioned about a periphery of the bin opening in the mounted position.

14. The refrigerator appliance of claim 10, wherein the ice storage bin further comprises a plurality of ice crusher blades fixed to the driven rod to rotate therewith about the rotation axis.

15. The refrigerator appliance of claim 10, wherein the ice storage bin further comprises an agitator paddle fixed to the driven rod to rotate therewith about the rotation axis.

16. The refrigerator appliance of claim 10, wherein the icemaker is mounted directly to the door.

17. The refrigerator appliance of claim 10, wherein the icemaker is mounted directly to the cabinet.

18. A refrigerator appliance comprising:

a cabinet defining a chilled chamber;

a door defining a bin opening and a dispenser recess below the bin opening, the door being rotatably hinged to the cabinet to rotate between a closed position restricting access to the chilled chamber and an open position permitting access to the chilled chamber;

a dispensing assembly positioned within the dispenser recess and defining an ice delivery passage;

an icemaker in selective communication with the dispensing assembly;

an ice storage bin defining a storage cavity, the ice storage bin being slidably mounted to the door to move horizontally along a rotation axis through the bin opening between a mounted position and a removed position, the ice storage bin comprising an insulated front wall positioned across the bin opening in the mounted position, the insulated front wall defining an unobstructed handle directly in front of the storage cavity, the storage cavity being in communication with the icemaker in the mounted position to receive ice therefrom, the storage cavity being in communication with the dispensing assembly in the mounted position to direct ice to the ice delivery passage; and a motor mounted to the door and operably coupled to the ice storage bin in the mounted position; and an adapter key fixed to the motor to rotate about the rotation axis parallel to a horizontal direction, the motor being operably coupled to the ice storage bin through the adapter key, wherein the ice storage bin comprises a driven rod extending horizontally along the rotation axis within the storage cavity, the driven rod being selectively coupled to the adapter key.

* * * * *